US010367309B2

(12) United States Patent
Tsai et al.

(10) Patent No.: US 10,367,309 B2
(45) Date of Patent: Jul. 30, 2019

(54) ELECTRICAL RECEPTACLE CONNECTOR

(71) Applicant: Advanced Connectek Inc., New Taipei (TW)

(72) Inventors: Yu-Lun Tsai, New Taipei (TW); Pin-Yuan Hou, New Taipei (TW); Hsu-Fen Wang, New Taipei (TW); Kai-Wei Lv, New Taipei (TW); Long-Fei Chen, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 15/853,995

(22) Filed: Dec. 26, 2017

(65) Prior Publication Data

US 2018/0183188 A1 Jun. 28, 2018

(30) Foreign Application Priority Data

Dec. 28, 2016 (CN) ..... 2016 1 1231618

(51) Int. Cl.

| | |
|---|---|
| ***H01R 13/66*** | (2006.01) |
| ***H01R 13/6585*** | (2011.01) |
| ***H01R 24/70*** | (2011.01) |
| ***H01R 12/71*** | (2011.01) |
| ***H01R 4/02*** | (2006.01) |
| ***H01R 13/6594*** | (2011.01) |
| ***H01R 13/6595*** | (2011.01) |
| *H01R 13/639* | (2006.01) |
| *H01R 107/00* | (2006.01) |
| *H01R 12/72* | (2011.01) |
| *H01R 24/60* | (2011.01) |

(52) U.S. Cl.

CPC ..... *H01R 13/6585* (2013.01); *H01R 4/02* (2013.01); *H01R 12/716* (2013.01); *H01R 13/6594* (2013.01); *H01R 13/6595* (2013.01); *H01R 24/70* (2013.01); *H01R 12/725* (2013.01); *H01R 13/639* (2013.01); *H01R 24/60* (2013.01); *H01R 2107/00* (2013.01)

(58) Field of Classification Search

CPC ..... H01R 13/6585; H01R 13/6594; H01R 13/6595; H01R 13/639; H01R 12/716; H01R 12/725; H01R 24/60; H01R 24/70; H01R 4/02; H01R 2107/00

USPC ..... 439/569, 570, 573, 660

See application file for complete search history.

(56) References Cited

U.S. PATENT DOCUMENTS

| | | | | |
|---|---|---|---|---|
| 4,824,383 A * | 4/1989 | Lemke | ..... | H01R 24/60 439/108 |
| 6,024,608 A * | 2/2000 | Azuma | ..... | H01R 13/41 439/660 |
| 8,894,445 B2 * | 11/2014 | Jol | ..... | H01R 24/62 439/108 |

(Continued)

*Primary Examiner* — Khiem M Nguyen

(74) *Attorney, Agent, or Firm* — JCIPRNET

(57) ABSTRACT

An electrical receptacle connector includes a shielding shell, an insulation housing and a plurality of terminals. The insulation housing is arranged inside the shielding shell and has a tongue portion extending to the outside of the shielding shell. The terminals are arranged at the insulation housing, and each terminal has a contact segment and a soldering segment. The contact segment is located on the tongue portion and protrudes from therefrom, the soldering segment extends from the insulation housing for a distance. The soldering segments are coplanar.

12 Claims, 4 Drawing Sheets

(56) References Cited

U.S. PATENT DOCUMENTS

| | | | | |
|---|---|---|---|---|
| 8,932,081 | B2 * | 1/2015 | Kamarauskas | H01R 13/41 439/607.35 |
| 8,936,493 | B2 * | 1/2015 | Fan | H01R 13/514 439/660 |
| 8,956,179 | B2 * | 2/2015 | MacDougall | H01R 13/641 439/489 |

* cited by examiner

ELECTRICAL RECEPTACLE CONNECTOR

CROSS-REFERENCE TO RELATED APPLICATION

This application claims the priority benefit of China patent application serial no. 201611231618.4, filed on Dec. 28, 2016. The entirety of the above-mentioned patent application is hereby incorporated by reference herein and made a part of the specification.

BACKGROUND

Field of the Invention

The application is directed to an electrical connector and more particularly, to an electrical receptacle connector.

Description of Related Art

An electrical connector is a commonly seen component on an electronic apparatus and is capable of being mutually connected with a corresponding electrical connector on another electronic apparatus to serves as a signal and power transmission medium between the electronic apparatuses. Currently existing electrical connectors include universal serial bus (USB) electrical connectors, for example. Currently available USB protocols newly add a Type C standard for electrical connectors. The USB Type-C connector can not only provide an ultra-high-speed rate of 10 Gbps for data transmission, but also have a symmetric plug capable of being normally and reversely plugged, thus, can be applied in various electronic apparatuses, for example, notebook computers.

SUMMARY

The application provides an electrical receptacle connector for being installed in an electronic apparatus and inserted by a corresponding electrical plug connector.

An electrical receptacle connector of the application includes a shielding shell, an insulation housing and a plurality of terminals. The insulation housing is arranged inside the shielding shell and has a tongue portion extending to the outside of the shielding shell. The terminals are arranged at the insulation housing, and each of the terminals has a contact segment and a soldering segment. The contact segment is located on the tongue portion and protrudes from the tongue portion by a distance, and the soldering segment extends from the insulation housing. The soldering segments are coplanar.

In an embodiment of the application, the electrical receptacle connector includes a locking element connected to the shielding shell, having a pair of locking holes for being locked to a rigid circuit board.

In an embodiment of the application, the locking element further includes a pair of positioning pieces for clamping the shielding shell.

In an embodiment of the application, the shielding shell has a pair of positioning portions, each of the positioning pieces has a positioning hole, and the pair of positioning portions are fitted with the positioning holes respectively.

In an embodiment of the application, each of the terminals has an extension segment located inside the insulation housing and inclined with respect to the corresponding contact segment and soldering segment.

In an embodiment of the application, the shielding shell has a rear cover portion, and the rear cover portion has a cover inclined surface parallel to the extension segments.

In an embodiment of the application, the insulation housing further has a base portion, the tongue portion extends from the base portion to the outside of the shielding shell, the terminals are arranged at the base portion and the tongue portion, the soldering segments extend from the base portion, and the base portion has a base inclined surface parallel to the extension segments.

In an embodiment of the application, the electrical receptacle connector further includes a sealing ring, the insulation housing has a ring-shaped groove, and the sealing ring is arranged in the ring-shaped groove and tightly fitted with the shielding shell.

In an embodiment of the application, the sealing ring is a rubber ring arranged around the ring-shaped groove or a filler injected into the ring-shaped groove.

In an embodiment of the application, the insulation housing further has an inlet communicating with the ring-shaped groove for injecting the filler.

In an embodiment of the application, the electrical receptacle connector complies with a USB Type-C standard.

Based on the above, in the application, the tongue portion the insulation housing extends to the outside of the shielding shell to prevent radio frequency interference. The contact segments of the terminals protrude from the tongue portion by a distance. Thus, when the insulation housing is manufactured by means of insert-molding, a plastic insulation material can be prevented from being left over on the contact segments of the terminals, thereby contributing to ensuring surface contact quality of the terminals. The electrical receptacle connector can be locked to the rigid circuit board through the locking element, so as to reinforce the structural strength. The structures, including the inclined extension segments of the terminals, the cover inclined surface of the rear cover portion of the shielding shell and the base inclined surface of the base portion of the insulation housing, can constitute a space for other components.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
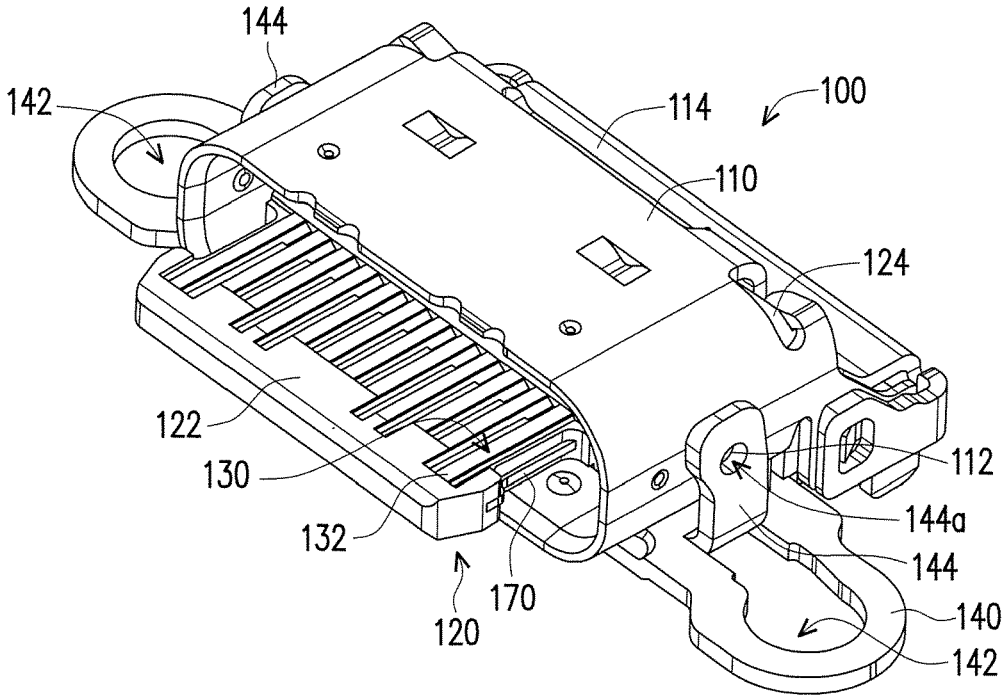
FIG. 1 is a top perspective view showing an electrical receptacle connector according to an embodiment of the application.

Referring to FIG. 1 to FIG. 6, in the present embodiment, an electrical receptacle connector 100 includes a shielding shell 110, an insulation housing 120 and a plurality of terminals 130. The insulation housing 120 is arranged inside the shielding shell 110. The terminals 130 are arranged at the insulation housing 120. The insulation housing 120 has a tongue portion 122 extending to the outside of the shielding shell 110 to prevent radio frequency interference. When the electrical receptacle connector 100 complies with a USB Type-C standard and provide a reversible or dual orientation USB Type-C connector and pin assignments, the terminals 130 may be located on two surfaces of the tongue portion 122 which enables an electrical plug connector to be inserted into a corresponding receptacle connector in either of two intuitive orientations, i.e. in either upside-up or upside-down directions. In other words, the terminals 130 are located on two surfaces of the tongue portion 122, i.e. upside surface and downside surface of the tongue portion 122, which enables an electrical plug connector to be inserted into a corresponding receptacle connector in either of two intuitive orientations. Furthermore, a reversible or dual orientation USB Type-C connector usually includes a shielding plate 170 embedded in side the tongue portion 122 of the insulation housing 120 and the shielding plate 170 is located between the terminals 130 which are located on two surfaces of the tongue portion 122, i.e. upside surface and downside surface of the tongue portion 122.

Figure 5:
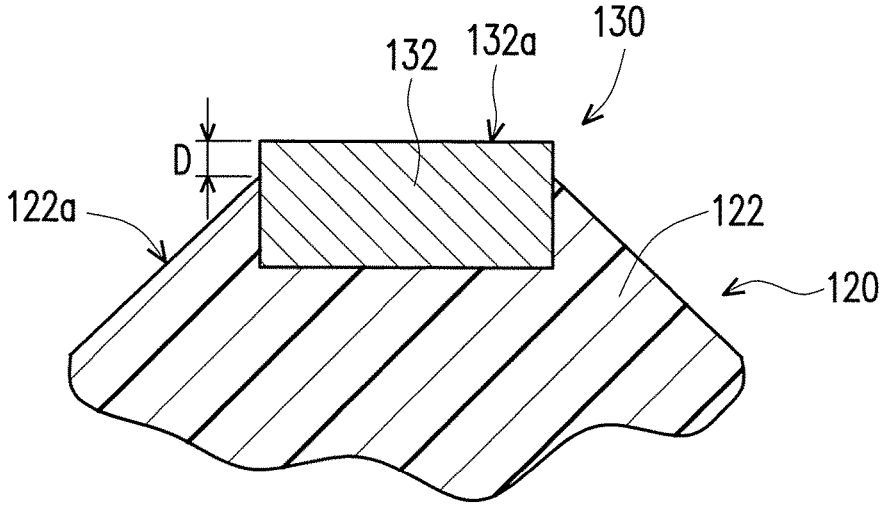
FIG. 5 is a partially cross-sectional view showing the contact segment of each the terminal and the tongue portion of the insulation housing of the electrical receptacle connector depicted in FIG. 1.

As shown in FIG. 1 and FIG. 5, each of the terminals 130 has a contact segment 132, and the contact segment 132 is located on the tongue portion 122 and protrudes from the tongue portion 122 by a distance D. Specifically, the contact segment 132 protrudes from a surface 122*a* of the tongue portion 122 by the distance D. In other words, the contact segment 132 protrudes above the surface of the tongue portion 122 by a distance D. Thus, when the insulation housing 120 is manufactured by means of insert-molding, a plastic insulation material is prevented from being left over on a top surface 132*a* of the contact segment 132 of each of the terminals 130, thereby contributing to ensuring surface contact quality of the terminals 130. Each of the terminals 130 further has a soldering segment 134, and the soldering segment 134 extends out the insulation housing 120. The soldering segments 134 are coplanar, i.e., arranged on the same geometric plane, to be soldered on a flexible circuit board or a rigid circuit board.

Figure 4:
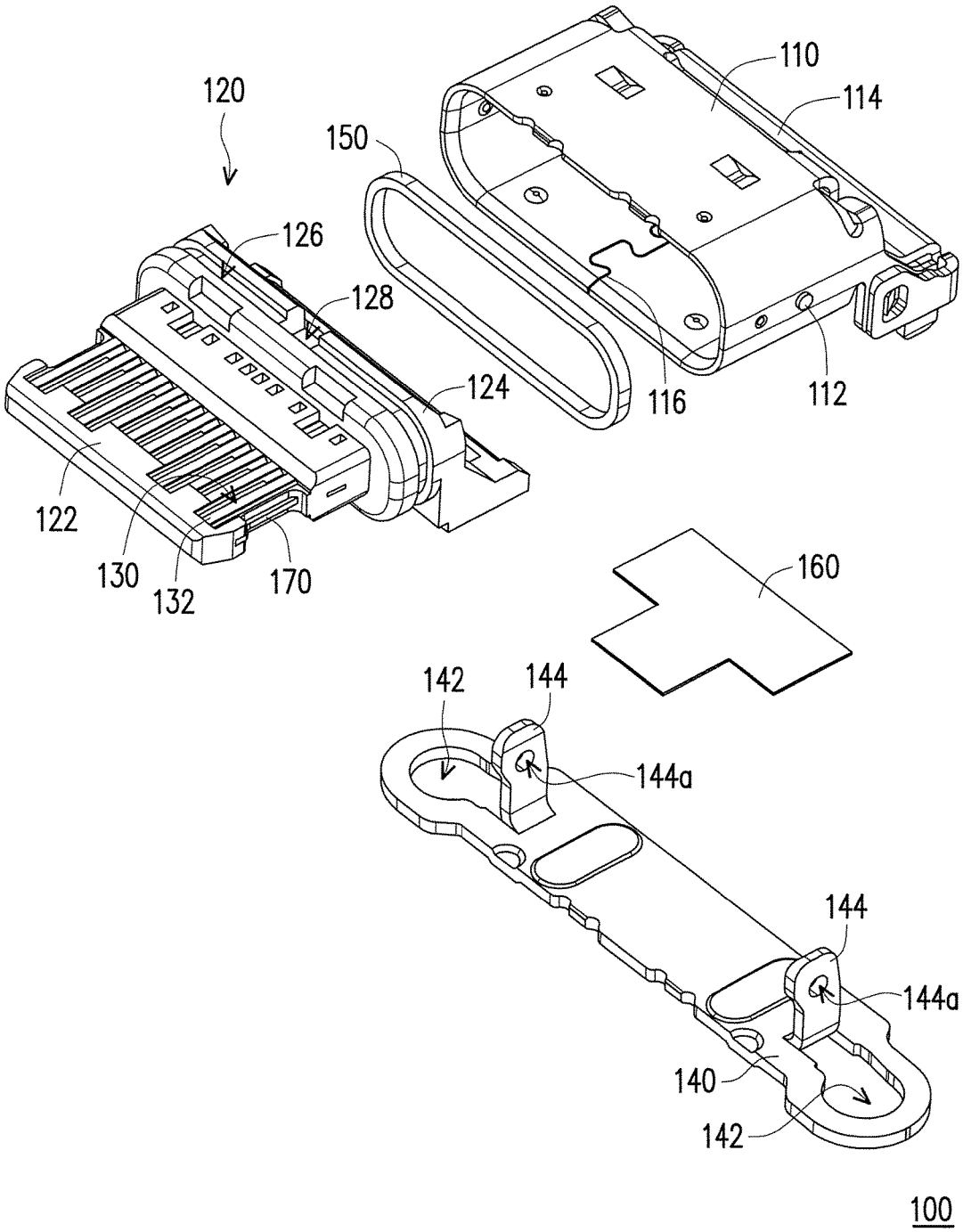
FIG. 4 is an exploded view showing the electrical receptacle connector depicted in FIG. 1.

In the present embodiment, as shown in FIG. 1 and FIG. 4, the electrical receptacle connector 100 further includes a locking element 140 which is connected to the shielding shell 110, has a pair of locking holes 142 and is used to be locked to the rigid circuit board, thereby reinforcing structural strength. For example, the electrical receptacle connector 100 may be fastened onto the rigid circuit board by screws passing through the locking holes 142. In addition, the locking element 140 further has a pair of positioning pieces 144 for clamping the shielding shell 110. In the present embodiment, the shielding shell 110 has a pair of positioning portions 112 (e.g., bumps), each of the positioning pieces 144 has a positioning hole 144*a*, and the positioning portions 112 are fitted with the positioning holes 144*a* respectively.

Figure 2:
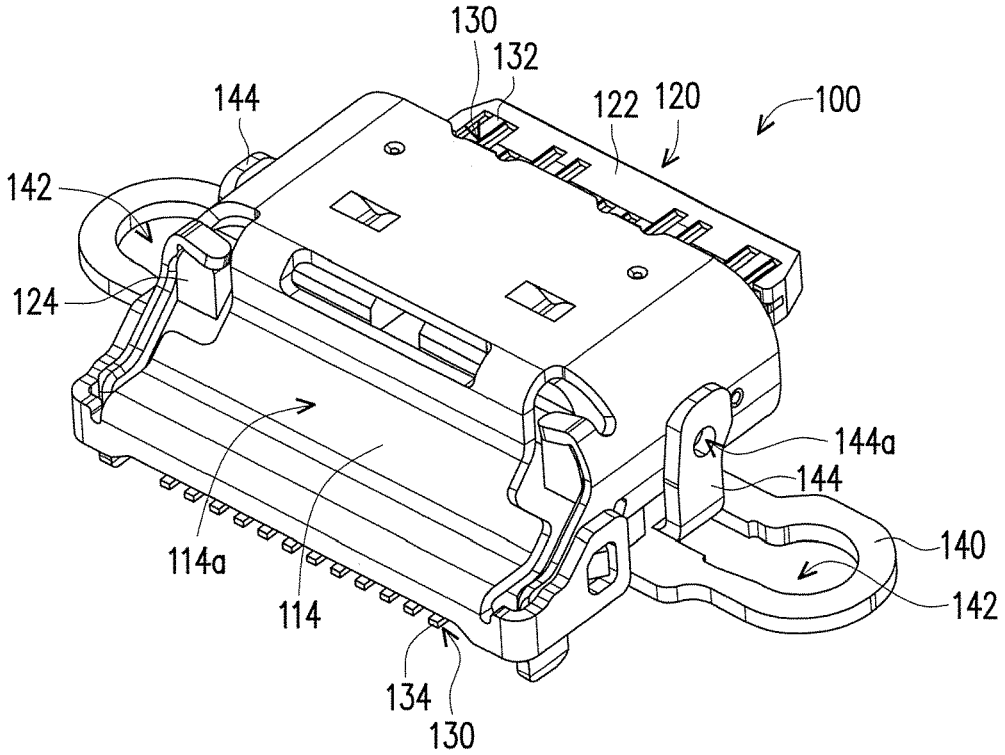
FIG. 2 is another top perspective view showing the electrical receptacle connector depicted in FIG. 1.
Figure 6:
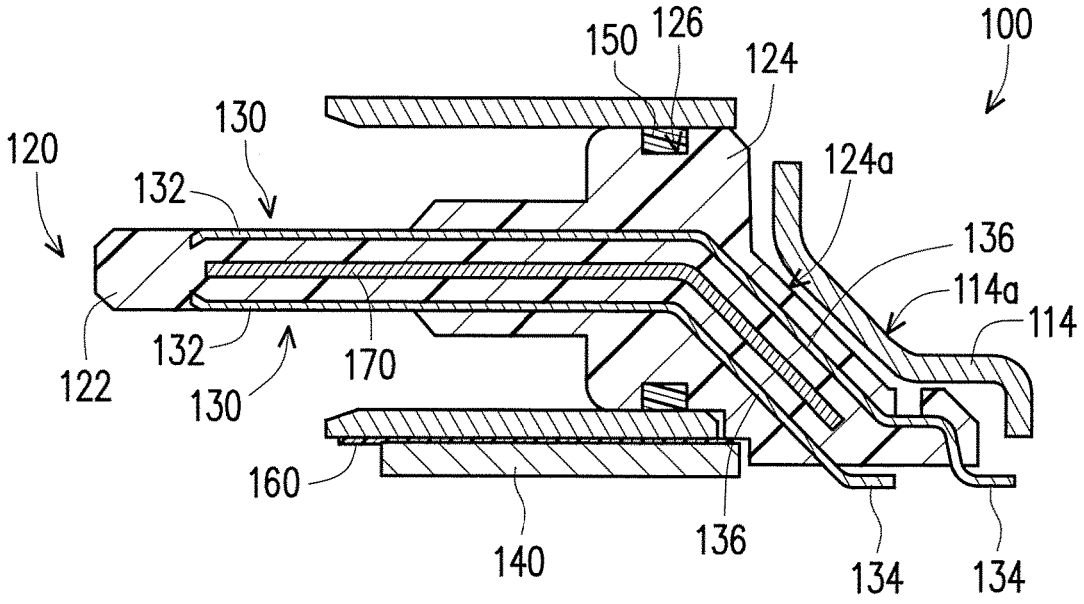
FIG. 6 is a cross-sectional view showing the electrical receptacle connector depicted in FIG. 1.

In the present embodiment, as shown in FIG. 1, FIG. 2 and FIG. 6, the insulation housing 120 further has a base portion 124, and the tongue portion 122 extends from the base portion 124 to the outside of the shielding shell 110. The terminals 130 are arranged at the base portion 124 and the tongue portion 122, and the soldering segments 134 extend from the base portion 124. Each of the terminals 130 has an extension segment 136 located inside the insulation housing 120 and inclined with respect to the corresponding contact segment 132 and the corresponding soldering segment 134.

However, as shown in FIG. 1, FIG. 2 and FIG. 4, when a space in rear of the electrical receptacle connector 100 is required for other components, the extension segments 136 of the terminals 130 may be inclined with respect to the corresponding contact segments 132 and the corresponding soldering segments 134. In the meantime, the shielding shell 110 has a rear cover portion 114, the rear cover portion 114 has a cover inclined surface 114*a*, and the base portion 124 has a base inclined surface 124*a*. The cover inclined surface 114*a* of the rear cover portion 114 and the base inclined surface 124*a* of the base portion 124 are parallel to the extension segments 136 of the terminals 130 and thus, are inclined with respect to the contact segments 132 and the soldering segments 134 of the terminals 130.

Figure 3:
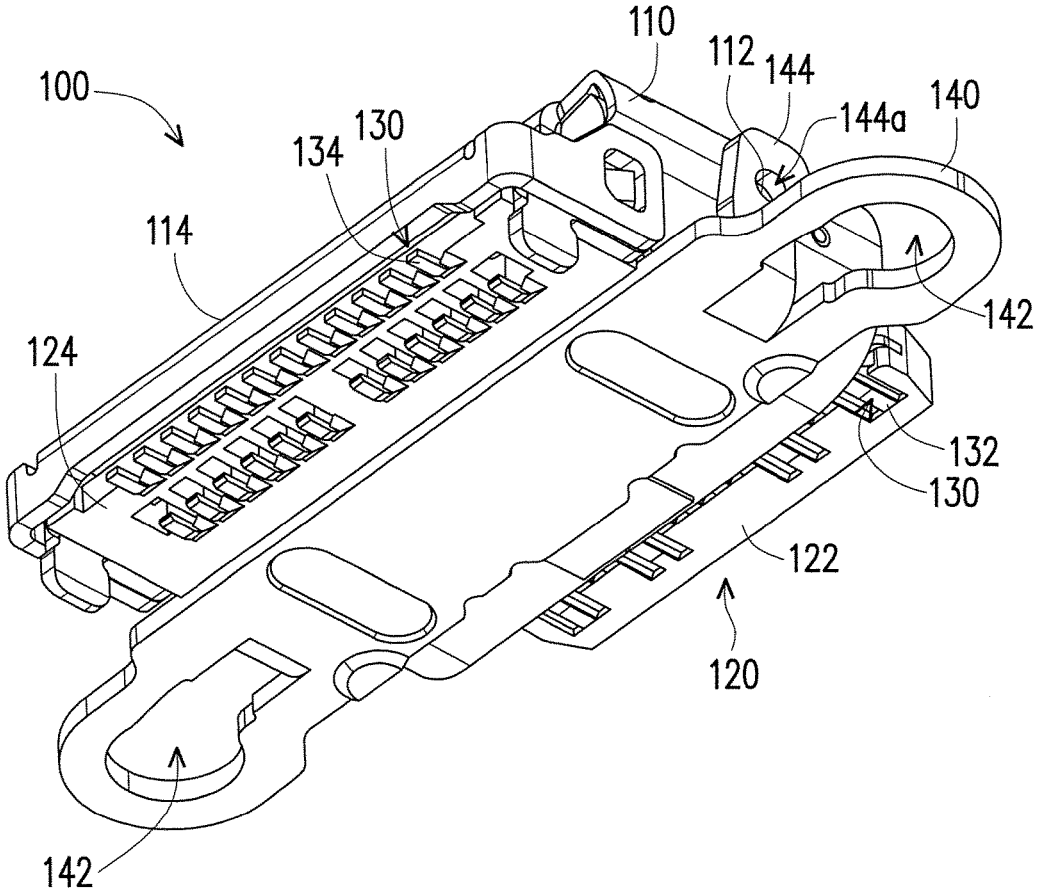
FIG. 3 is a bottom perspective view showing the electrical receptacle connector depicted in FIG. 1.

In the present embodiment, as shown in FIG. 3, FIG. 4 and FIG. 6, the insulation housing 120 has a ring-shaped groove 126, and the electrical receptacle connector 100 further includes a sealing ring 150 (referring to FIG. 6). The sealing ring 150 is arranged in the ring-shaped groove 126 and tightly fitted with the shielding shell 110. In the present embodiment, the sealing ring 150 is a rubber ring arranged around the ring-shaped groove 126 or a filler injected into the ring-shaped groove 126. In terms of the latter, as shown in FIG. 3 and FIG. 4, the insulation housing 120 further has an inlet 128 communicating with the ring-shaped groove 126 for injecting the filler.

In the present embodiment, as shown in FIG. 4 and FIG. 6, the electrical receptacle connector 100 further includes a sealing film 160 arranged between the shielding shell 110 and the locking element 140 to prevent a liquid from penetrating a gap 116 of the shielding shell 110.

In view of the foregoing, in the application, the tongue portion of the insulation housing extends to the outside of the shielding shell to prevent radio frequency interference. The contact segments of the terminals protrude from the tongue portion by a distance. Thus, when the insulation housing is manufactured by means of insert-molding, the plastic insulation material be prevented from being left over on the top surfaces of the contact segments of the terminals, thereby contributing to ensuring surface contact quality of the terminals. The electrical receptacle connector can be locked to the rigid circuit board through the locking element, so as to reinforce the structural strength. The structures, including the inclined extension segments of the terminals, the cover inclined surface of the rear cover portion of the shielding shell and the base inclined surface of the base portion of the insulation housing, can constitute a space for other components.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. An electrical receptacle connector, comprising:

a shielding shell;

an insulation housing arranged inside the shielding shell and having a tongue portion extending to the outside of the shielding shell;

a plurality of terminals arranged at the insulation housing, wherein each of the terminals has a contact segment and a soldering segment, the contact segment is located on the tongue portion and protrudes from the tongue portion by a distance, the soldering segment extends out the insulation housing, and the soldering segments are coplanar; and a shielding plate embedded inside the tongue portion of the insulation housing and located between the terminals which are located on two surfaces of the tongue portion.

2. The electrical receptacle connector according to claim 1, comprising:

a locking element connected to the shielding shell and having a pair of locking holes for being locked to a rigid circuit board.

3. The electrical receptacle connector according to claim 2, wherein the locking element further comprises a pair of positioning pieces for clamping the shielding shell.

4. The electrical receptacle connector according to claim 3, wherein the shielding shell has a pair of positioning portions, each of the positioning pieces has a positioning hole, and the pair of positioning portions are fitted with the positioning holes respectively.

5. The electrical receptacle connector according to claim 1, wherein each of the terminals has an extension segment located inside the insulation housing, connected to the contact segment and the soldering segment of the terminal and inclined with respect to the contact segment and the soldering segment of the terminal.

6. The electrical receptacle connector according to claim 5, wherein the shielding shell has a rear cover portion, and the rear cover portion has a cover inclined surface parallel to the extension segments.

7. The electrical receptacle connector according to claim 5, wherein the insulation housing further has a base portion, the tongue portion extends from the base portion to the outside of the shielding shell, the terminals are arranged at the base portion and the tongue portion, the soldering segments extend from the base portion, and the base portion has a base inclined surface parallel to the extension segments.

8. The electrical receptacle connector according to claim 1, further comprising:

a sealing ring, the insulation housing having a ring-shaped groove, and the sealing ring being arranged in the ring-shaped groove and tightly fitted with the shielding shell.

9. The electrical receptacle connector according to claim 8, wherein the sealing ring is a rubber ring arranged around the ring-shaped groove.

10. The electrical receptacle connector according to claim 8, wherein the sealing ring is a filler injected into the ring-shaped groove.

11. The electrical receptacle connector according to claim 10, wherein the insulation housing further has an inlet communicating with the ring-shaped groove for injecting the filler.

12. The electrical receptacle connector according to claim 1, wherein the electrical receptacle connector complies with a USB Type-C standard.

* * * * *